US006547464B1

(12) United States Patent
Lewis et al.

(10) Patent No.: US 6,547,464 B1
(45) Date of Patent: Apr. 15, 2003

(54) AUTOMATED TRANSACTION MACHINE PRINTER

(75) Inventors: Kim R. Lewis, Stow, OH (US); Jeffrey A. Hill, Canton, OH (US); Richard C. Lute, Jr., Mogadore, OH (US)

(73) Assignee: Diebòld, Incorporated, North Canton, OH (US)

( * ) Notice: Subject to any disclaimer, the term of this patent is extended or adjusted under 35 U.S.C. 154(b) by 0 days.

(21) Appl. No.: 09/707,534

(22) Filed: Nov. 7, 2000

Related U.S. Application Data

(60) Provisional application No. 60/168,330, filed on Dec. 1, 1999.

(51) Int. Cl.[7] ..... B41J 15/16
(52) U.S. Cl. ..... 400/613; 400/618
(58) Field of Search ..... 400/613, 621, 400/618, 611, 23, 48

(56) References Cited

U.S. PATENT DOCUMENTS

| | | | | | |
|---|---|---|---|---|---|
| 3,586,149 | A | * | 6/1971 | Miller | 400/618 |
| 5,215,393 | A | * | 6/1993 | Wincent | 400/621 |
| 5,417,413 | A | * | 5/1995 | Huffman et al. | 271/225 |
| 5,779,379 | A | * | 7/1998 | Mason et al. | 101/228 |
| 5,879,092 | A | * | 3/1999 | Brannan et al. | 400/708 |
| 6,028,318 | A | * | 2/2000 | Cornelius | 250/559.27 |
| 6,109,804 | A | * | 8/2000 | Higashi et al. | 400/611 |
| 6,299,367 | B1 | * | 10/2001 | Kawakami et al. | 400/634 |

FOREIGN PATENT DOCUMENTS

| | | | | |
|---|---|---|---|---|
| JP | 04-323157 | A | * 11/1992 | |
| JP | 05092626 | A | * 4/1993 | B41J/11/42 |
| JP | 9-314879 | A | * 12/1997 | |

OTHER PUBLICATIONS

Machine translation of JP 5–092626 from JPO website.*

* cited by examiner

*Primary Examiner*—Daniel J. Colilla
(74) *Attorney, Agent, or Firm*—Ralph E. Jolke; Daniel D. Wasil; Walker & Jolke

(57) ABSTRACT

An automated transaction machine (10) includes a thermal printing apparatus for printing account statements for a user. A paper drive (36) moves a paper web (44) from a paper roll (42) through a printer (40). After indicia is printed on the paper, the paper is cut by a cutter (37) into sheets and delivered to a user by a presenter drive (30). After paper cutting, the paper is moved a short distance in a direction opposed to the direction that the paper normally moves during printing. A paper control device (49) operates to maintain a relatively constant resistance force to movement of the web in the printing direction after the paper has been retracted. The paper control device limits application of resistance forces to below a threshold as well as sudden fluctuation of resistance forces on the paper web which may otherwise cause the paper to slip relative to the drive and cause distortion of printed indicia or damage to the web.

38 Claims, 10 Drawing Sheets

AUTOMATED TRANSACTION MACHINE PRINTER

This application claims benefit of provisional application Ser. No. 60/168,330 filed Dec. 1, 1999.

TECHNICAL FIELD

This invention relates to automated transaction machines. Specifically this invention relates to an automated transaction machine that includes a printing device for printing account statements or other relatively large documents. A paper control device is provided to assure relatively uniform resistance to paper movement and to achieve undistorted printing and reliable cutting of the paper.

BACKGROUND ART

Automated transaction machines are known in the prior art. One type of automated transaction machine is an automated teller machine ("ATM"). ATMs have been developed which are capable of performing a variety of transactions. These transactions may include the dispensing of currency notes or other documents of value. ATMs may also accept deposits in the form of sheets or envelopes. ATMs are also sometimes provided with the capabilities of dispensing or receiving tickets, travelers checks, vouchers, stamps, gaming materials or other items of value. Other types of automated transaction machines may be operated by service providers such as cashiers and bank tellers. Such transaction machines may dispense or receive cash or other documents. Other types of automated transaction machines may include currency counting units, currency acceptors, scrip terminals or other devices. For purposes of this disclosure, an automated transaction machine shall be considered to be any machine that is capable of carrying out transactions involving transfers of value.

It is common for some types of automated transaction machines to provide the user with a printed record or receipt for each transaction. Such receipts typically show the type of transaction and the value or amount involved. Other information may also be included on the receipt depending on the type of machine and the transaction. Receipts may include information such as the user's name, the time of day, a location where the transaction was conducted, an account involved as well as one or more account balances.

Certain types of automated transaction machines also enable a user to obtain a printed record of transactions that have been conducted. This record may comprise an account statement which indicates activity concerning a particular account. For example, a consumer operating certain ATMs may obtain an account statement which shows additions and withdrawals to their savings or checking account. An account statement in the case where the transaction machine is operated by a service provider, may include information concerning transactions carried out by the service provider or transactions carried out at a particular machine. Such statements may include information concerning a plurality of transactions that were conducted over a certain time period or information concerning transactions of particular types or in particular categories.

It is often desired to print account statements on larger size paper than transaction receipts. An account statement may include several sheets of such paper depending on the number of transactions for which information is provided. To achieve the printing of such statements, larger and heavier rolls of paper may be needed to supply the printers which print such statements. Such larger rolls are not only necessary to accommodate the larger size of the paper but also to minimize the frequency of paper replenishment. Such larger paper rolls have higher inertia and offer a generally higher resistance to movement by a printing mechanism than smaller paper rolls used in connection with many receipt printers.

A particular type of printer that may be used for printing account statements is a thermal printer. Thermal printers operate in connection with thermal paper. Thermal printers produce localized temperature differences which cause permanent color changes in the paper. Such color changes may be used to produce indicia including numbers, letters and graphics in accordance with the operation of the computer or other device that electronically drives the thermal printing mechanism.

In the printing of account statements using a thermal printer arrangement, a continuous paper web from a supply roll generally moves in a first direction through the thermal printing device during printing. However, with some types of thermal printer devices or in some situations it is necessary or desirable to retract the paper web in a direction opposed to the normal direction of paper movement during printing. This may be desirable in certain situations such as after the paper is cut. This may be done to achieve proper positioning and alignment of the paper with the printing mechanism as printing is recommenced. This retraction movement may pose a potential problem when large and heavy rolls of paper are used such as in printing account statements.

A potential problem may arise because when the paper is retracted, a portion of the web located between the printer and the paper roll accumulates untensioned slack in the paper. When the printer begins moving the paper forward again during printing operations, the paper drive used to move the paper web through the printer initially meets very low resistance to paper movement. However, after the untensioned slack is removed from the paper, the drive suddenly encounters a much greater resistance as the drive is required to move the paper roll and to overcome the inertia thereof. This sudden change in resistance to paper movement may cause the drive to slip relative to the paper. This may result in the printing of improperly spaced lines, the distortion of printed indicia or even tearing of the paper web.

Thus there exists a need for an automated transaction machine with a more useful printing device. There further exists a need for an automated transaction machine which is capable of reliably printing relatively large size documents such as account statements. There further exists a need for an automated transaction machine which includes a paper control device which maintains a generally uniform resistance force to movement of the paper even after the paper has moved in a direction opposite to that in which the paper normally moves during printing.

DISCLOSURE OF INVENTION

It is an object of the exemplary form of the present invention to provide an automated transaction machine.

It is a further object of the exemplary form of the present invention to provide an automated transaction machine which is capable of providing relatively large printed documents.

It is a further object of the exemplary form of the present invention to provide an automated transaction machine which provides account statements printed using a thermal printer.

It is a further object of the exemplary form of the present invention to provide an automated transaction machine which includes a paper control device that maintains a generally uniform resistance to paper movement in the printing direction.

It is a further object of the exemplary form of the present invention to provide an automated transaction machine that is economical to use and operate.

It is a further object of the exemplary form of the present invention to provide a printing apparatus suitable for printing on paper supplied from a relatively large and heavy paper roll.

It is a further object of the exemplary form of the present invention to provide a method for operating a printing device while maintaining a generally uniform resistance to paper movement in the printing direction.

Further objects of the exemplary form of the present invention will be made apparent in the following Best Modes For Carrying Out Invention and the appended claims.

The foregoing objects are accomplished in an exemplary embodiment of the present invention by an automated transaction machine. The exemplary automated transaction machine is an ATM. The ATM operates to carry out banking transactions for users such as dispensing currency or receiving deposits. The ATM is also enabled to be operated to print account statements for customers.

The ATM of the exemplary embodiment includes a machine housing. The housing includes a user interface including input and output devices for enabling operation of the machine by a user. The user interface also includes a sheet outlet for delivering account statements printed by the machine.

The ATM of the exemplary embodiment includes a thermal printing apparatus within the housing. The thermal printing apparatus prints documents which are cut from a web of paper which is fed to the printer from a relatively large paper roll. Sheets comprising account statements are printed using the thermal printer and presented to the user through the sheet outlet opening.

A paper control device acts on the paper web intermediate of the thermal printer and the paper roll. The paper control device operates to maintain a generally constant resistance force to movement of the paper in the direction that the paper web normally moves during printing. The paper control device operates to maintain such generally constant resistance force even after the paper web has been retracted for purposes of cutting and/or realignment. The paper control device reduces the risk that the paper will encounter a significant sudden fluctuation in resistance force which would otherwise occur. The web is also prevented from being exposed to excessively high resistance forces and the application of increased resistance force is made more gradual. Reducing variations in resistance to paper movement minimizes paper slippage, avoids losses in print quality and/or minimizes the risk of damage to the paper web.

BEST MODES FOR CARRYING OUT THE INVENTION

Figure 1:
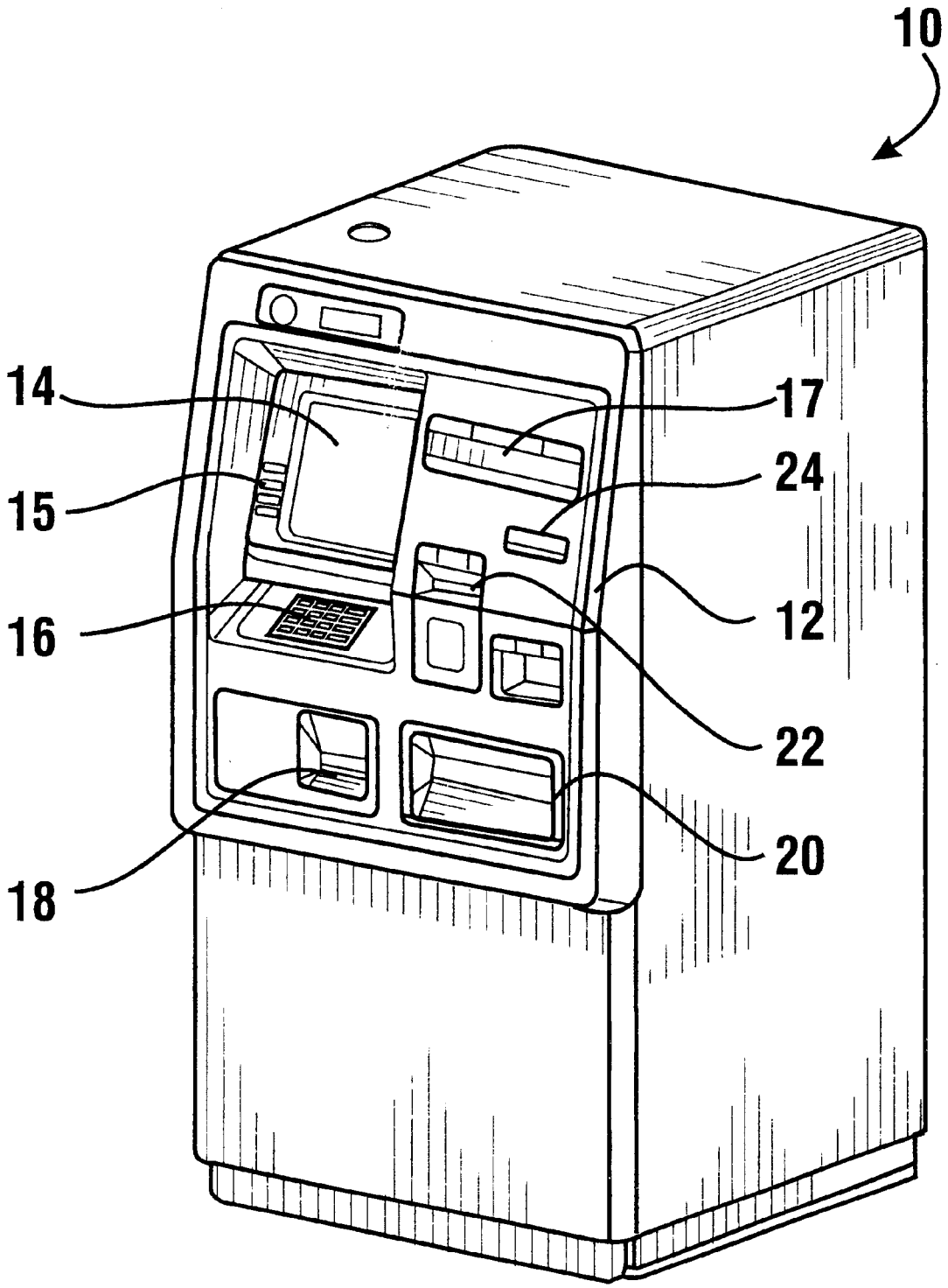
FIG. 1 is an isometric view of an exemplary automated transaction machine incorporating features of the present invention.

Referring now to the drawings and particularly to FIG. 1, there is shown therein an automated transaction machine generally indicated 10 incorporating an exemplary embodiment of the present invention. The exemplary embodiment of the invention is used in connection with an ATM. However, it should be understood that the present invention may be used in connection with other types of automated transaction machines. In addition, while the exemplary embodiment is shown positioned within a housing of an ATM, other embodiments of the invention may be positioned within a separate housing that is electronically connected to the automated transaction machine with which it is associated.

In the exemplary embodiment, ATM 10 operates to carry out transactions such as the dispensing of currency. The machine may also operate to accept deposits such as deposited sheets or envelopes. The machine may also print and dispense other types of sheets such as receipts, tickets, vouchers, stamps or other items. The exemplary embodiment also operates to print and deliver account statements to users. The account statement may be printed in various formats. In an exemplary embodiment, the account statements include indicia which represent transactions conducted on one or more of a user's accounts. Such account statements may show various types of transactions. For example, the statement may reflect all account activity over a particular time period. Alternatively, account statements may segregate account information by transaction type, amount or other parameters. In other embodiments other types of documents may be printed.

In the exemplary embodiment, each account statement may include several sheets of paper which are printed and delivered to the ATM customer. In the exemplary embodiment to provide more account details in a more desirable format, the account statements are printed on relatively large sized paper such as paper that may be at least about five inches in width. This is larger than the relatively smaller paper generally used for providing customer transaction receipts at ATM machines.

ATM 10 includes a fascia 12 which includes components of a user interface. The fascia includes an opening through which a display 14 may be viewed. The display may be a CRT, LCD or other type visual display that is operative to display visual images and indicia to a user. The messages output through the display may include messages which instruct a user concerning operation of the machine. The user interface also includes a plurality of function keys 15 adjacent to the display. The user interface also includes a keyboard 16. Users are enabled to provide inputs and instructions to the machine by selectively pressing selected keys among the function keys and the keyboard.

The fascia of ATM 10 also includes openings which communicate with devices and mechanisms located within the housing of the machine. In the exemplary embodiment, a depository opening 18 is provided. Users are enabled to place deposits such as sheets or envelopes that are accepted by the machine into the depository opening in the conduct of deposit transactions. A sheet outlet opening 20 is also provided. Currency notes or other documents are presented to users in the course of cash dispense transactions through the sheet outlet opening.

The fascia also includes a receipt opening 24. The receipt opening is used to provide users with printed receipts for transactions conducted at the machine. The user interface also includes a card entry slot 22. In the exemplary embodiment, a user is enabled to pass a card through the entry slot to initiate operation of the machine. The machine includes a card reader in the interior thereof which is in communication with the card entry slot. The card reader is operative to read a magnetic stripe on a card presented by a user. The magnetic stripe of a presented card includes information which identifies a user and/or their accounts. In the exemplary embodiment, the card reader is enabled to read information included on debit cards and/or credit cards.

It should be understood that the input and output devices shown in the user interface are exemplary. Other embodiments of the invention may include other or different types of output and input devices. These include, for example, other types of card readers or other types of devices for reading cards or articles. It should be understood that other types of identifying cards may also be employed with machines which incorporate the invention. Such cards may include so called "smart cards" which include a programmable memory having data stored therein. Such data may include information about the user and/or their accounts. Such data may also include information representative of monetary value. Value may be deducted from the memory as the card is used to obtain value in other forms, such as by using the card to make purchases. Some cards may also have the value thereon periodically replenished such as through operation of the ATM.

Other embodiments of machines which utilize the invention may include input devices which may read other articles, such as articles encoded with optical indicia which identify a user, an account or other information. Other input devices which may be used include devices which read inductance or radiation properties of an article. Other types of input devices may include biometric type reading devices such as fingerprint readers, retina scan devices, iris scan devices, speech recognition devices or other types of input devices which are capable of providing an input which can be used to identify a particular user and/or their accounts.

It should be understood that the keyboard and function keys which serve as input devices in the described embodiment are exemplary. In other embodiments, other types of input devices which are capable of receiving data or instructions from a user may be used. Other types of output devices may also be used in other embodiments. These may include other types of visual and nonvisual output devices which are capable of communicating messages to a user and which can instruct the user or provide information concerning operation of the machine.

The exemplary user interface of ATM 10 includes a statement printer outlet opening 17. Statement outlet opening 17 is used for delivering sheets which comprise account statements to users of the machine. It should be understood that while in the exemplary embodiment account statements are delivered to the user through a fascia of the machine, alternative embodiments may deliver such statements to the user from a separate device, or housing that is in electronic connection with the transaction machine. For example, a computer operating in ATM 10 may be in communication with one or more local or remote computers. Such computers may be in operative connection with one or more data stores which include data representative of transactions conducted by a user. The computer operating in the ATM may cause such data to be accessed in response to instructions from a user at the ATM. Such data may be accessed by the computer operating in the ATM or by other computers operating in or adjacent to the separate device or housing. This enables printing of the account statement requested by the user locally in proximity to the user.

Figure 2:
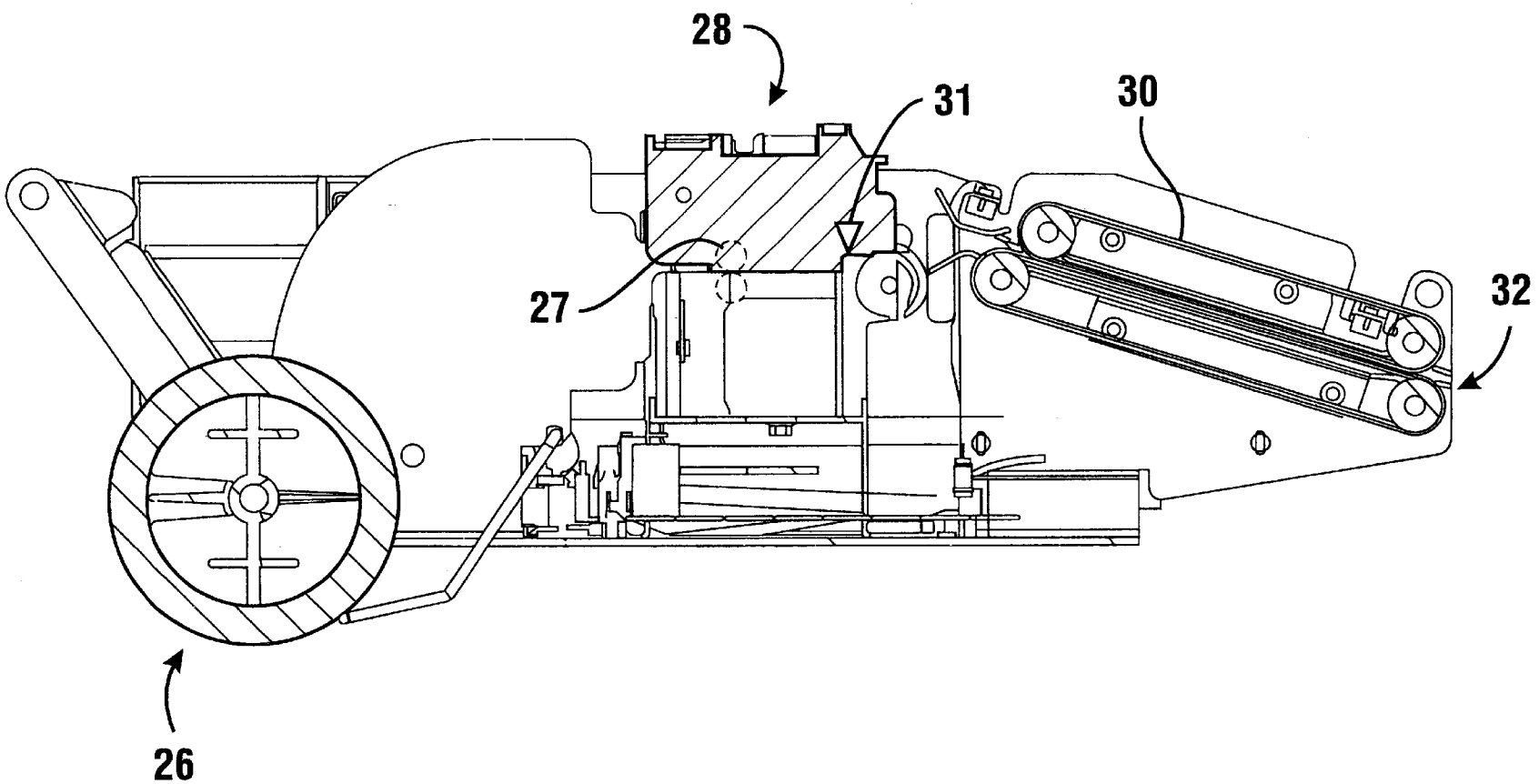
FIG. 2 is a side view of a printing arrangement inside the housing of the machine shown in FIG. 1.

FIG. 2 shows an exemplary printing arrangement for printing account statements inside the housing of ATM 10. The printing arrangement is operative to print indicia on paper that extends in a paper path. The paper path extends from a supply, which in the exemplary embodiment includes a paper roll 26. The paper is delivered from the printing apparatus in a delivery area 32. A paper web extends from the paper roll to a printer 28. A paper drive schematically indicated 27 inside the printer 28 engages the paper and selectively moves the web along the paper path. In the exemplary embodiment the drive includes a pair of generally opposed rolls or similar members that are moved responsive to a motor or other actuator so as to move the paper in a controlled manner in engagement between the rolls. Of course in other embodiments other drives for achieving controlled movement of paper may be used.

A cutter schematically indicated 31 is positioned adjacent to the paper path in printer 28. The cutter is selectively operative to transversely cut the paper web into sheets. A presenter drive 30 engages the paper and after cutting selectively moves the sheets toward the delivery area. The delivery area is adjacent to outlet opening 17. The presenter drive 30 enables extending the paper through the outlet opening so that it can be accessed by a user. It should further be understood that the outlet opening 17 may have adjacent thereto a suitable gate or other mechanism which prevents access through the opening except when the machine is delivering statements to a user. Alternative embodiments of the invention may include additional mechanisms such as devices for accumulating sheets into a stack and presenting the stack to a user of the machine.

The types of printers which may be used in embodiments of the invention may be capable of printing documents using various printing techniques. Such techniques may include impact printing, ink jet printing, laser printing, thermal printing or other techniques suitable for producing printed indicia. The printer 28 while supplied with paper from a paper roll in the exemplary embodiment may alternatively be provided with paper from other types of paper supplies such as a fan fold stack of paper or other source of continuous or noncontinuous paper. In the exemplary embodiment, the printer is a thermal type printer and the paper is supplied to the printer as a generally continuous web from a roll of thermal sensitive paper.

The thermal printer and other devices of the statement printer are operated responsive to signals from one or more computers operating in the ATM. The computer provides the appropriate signals which achieve printing of the desired indicia on the paper. The computer also provides the signals to achieve the desired movement, cutting and delivery of the paper in coordinated relation with the printing activities and other transaction functions carried out by the ATM.

Figure 3:
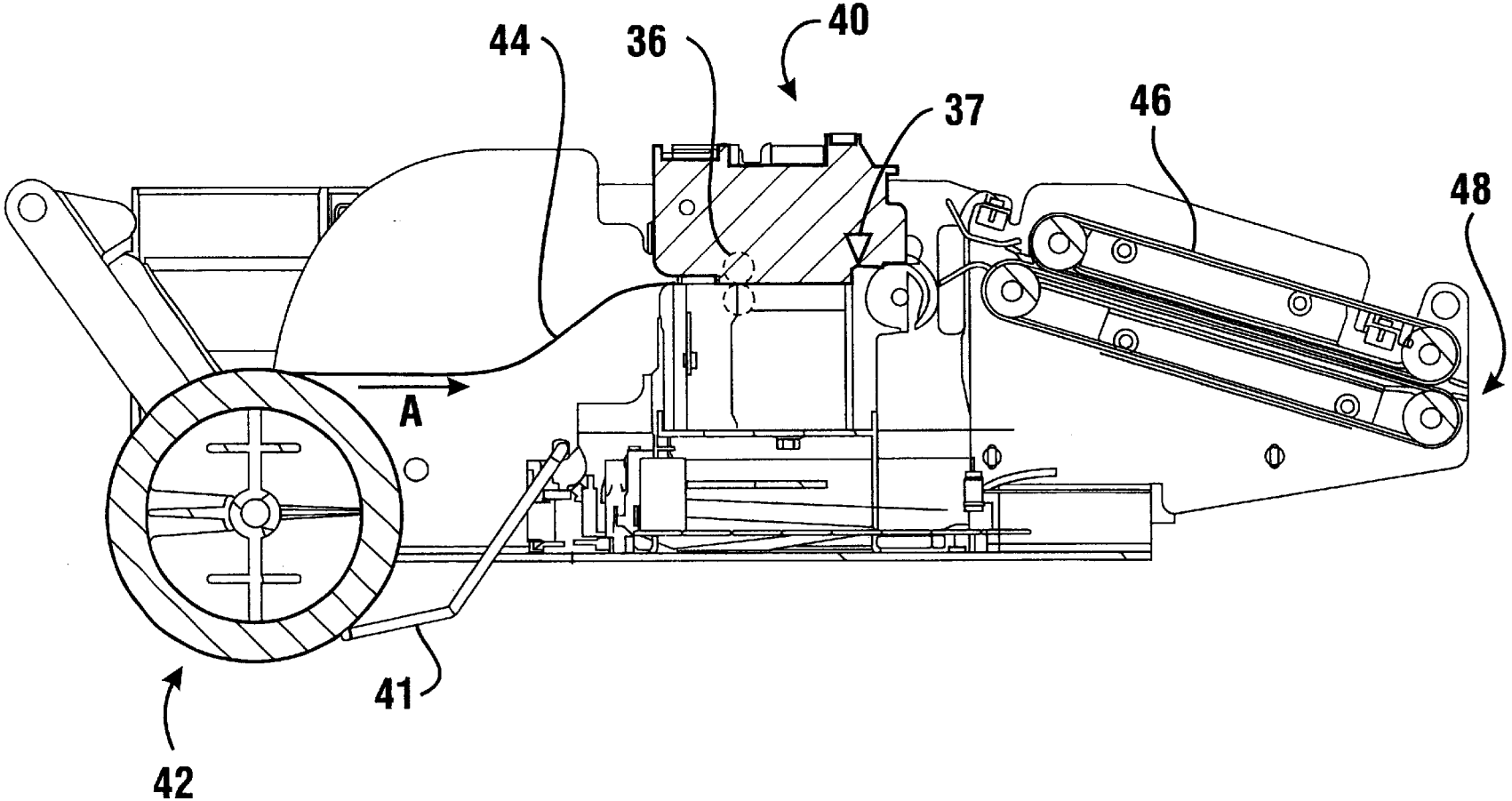
FIG. 3 is a side view similar to FIG. 2 which demonstrates the operation of the printer when used without certain features of the present invention.

FIG. 3 shows a thermal printing arrangement similar to that shown in FIG. 2. The printing arrangement shown in FIG. 3 includes a thermal printer 40 which includes a drive 36 and a cutter 37 generally like that described in connection with printer 28. The printing arrangement in FIG. 3 also includes a thermal paper roll 42, a presenter drive 46 and a delivery area 48. The paper normally moves in the direction of arrow A during printing thereon. In the exemplary thermal printer used in this embodiment, it is desirable to move the paper web a short distance in a direction opposed of the direction the paper is normally moved during printing each time after the paper web is cut. This is done to achieve proper positioning and alignment of the paper with the printing mechanism as printing on each new sheet is started. This further enables positioning the cutter device away from the mechanism which causes the indicia to be printed which provides enhanced reliability and avoids the deposit of residues that may be developed during cutting operations on components of the printing mechanism.

A drawback in the configuration shown is that after the paper is retracted, the portion of the paper web located between the printer and the paper roll tends to sag and accumulate loose slack. FIG. 3 shows this situation after the paper has been retracted by thermal printer 40. As can be seen, the paper web 44 has accumulated loose slack between the printer and the paper roll. In this condition when the paper drive begins to move the paper in the printing direction, it initially meets very low resistance as the slack is being taken out of the paper. After the slack is removed, the paper drive may suddenly encounter a relatively much greater resistance due to the inertia of the relatively large roll 42. In addition, the exemplary embodiment includes a drag device 41 which comprises a spring loaded member that acts on the roll 42. Drag device 41 applies a drag force to prevent the roll from overrunning when the paper starts and stops. The sudden application of an increased resistance force due to inertia of the roll and the drag may cause the paper to slip relative to the movement of drive 36. This may result in distortion of the indicia being printed by printer 40. Such distortion may render the indicia illegible in certain areas of printed documents. In some circumstances an abrupt application of increased force may tear the paper web.

In an exemplary embodiment of the present invention, a paper control device is positioned to engage the paper web between the supply and the drive. The paper control device acts on the paper to take up slack and change the orientation of the web. By maintaining tension in the web and by changing the paper orientation, the resistance to paper movement by the drive is maintained generally constant, that is for purposes of the exemplary embodiment, within a suitable range in which paper slippage is generally avoided. In this way, even after the paper web has been retracted, the drive is enabled to move the paper web reliably in the printing direction without encountering excessive force fluctuations which may cause distortion in the printed indicia and/or damage to the paper.

Figure 4:
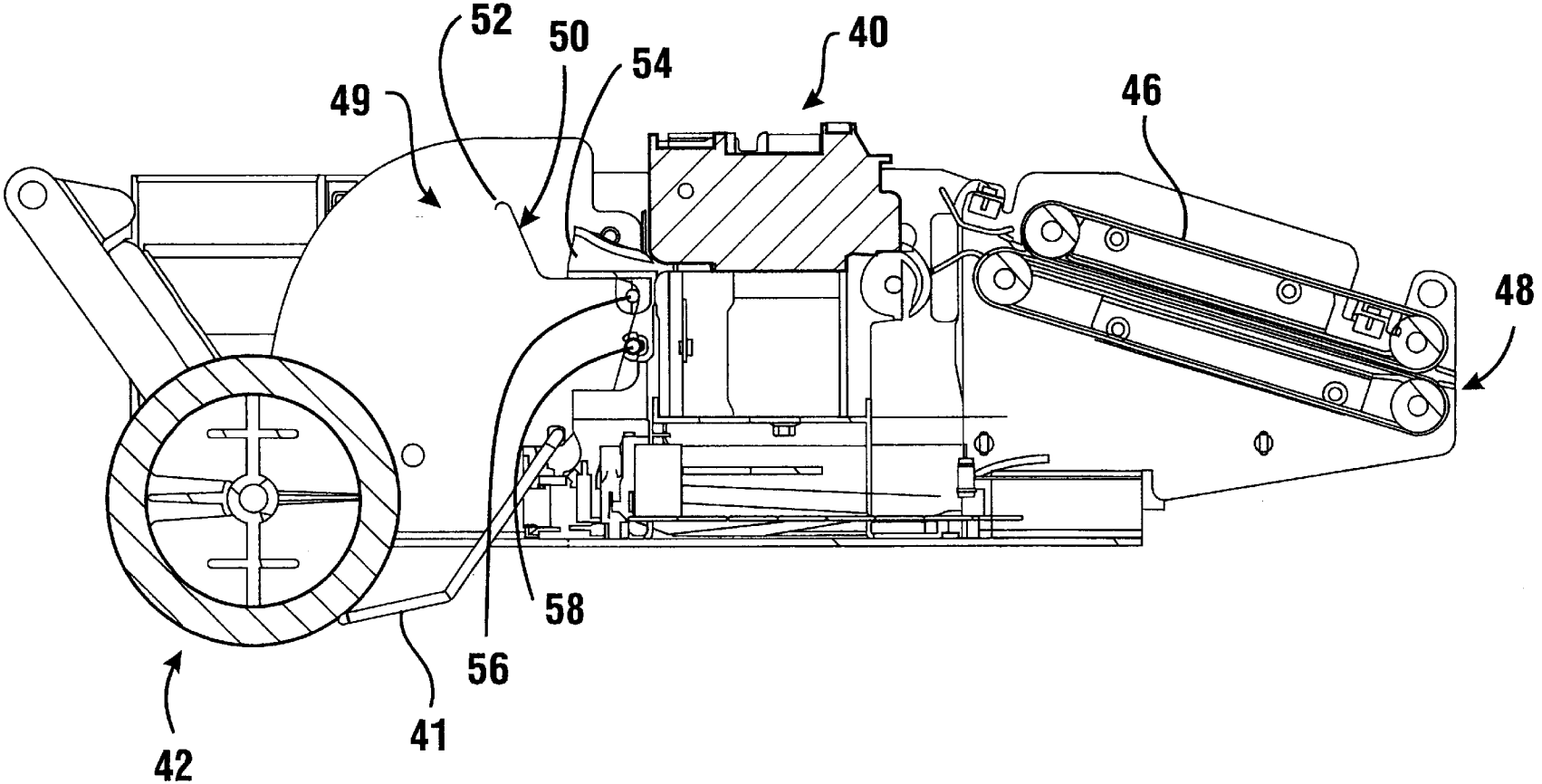
FIG. 4 is a view similar to FIG. 3 including a paper control device used in an exemplary embodiment of the present invention.
Figure 7:
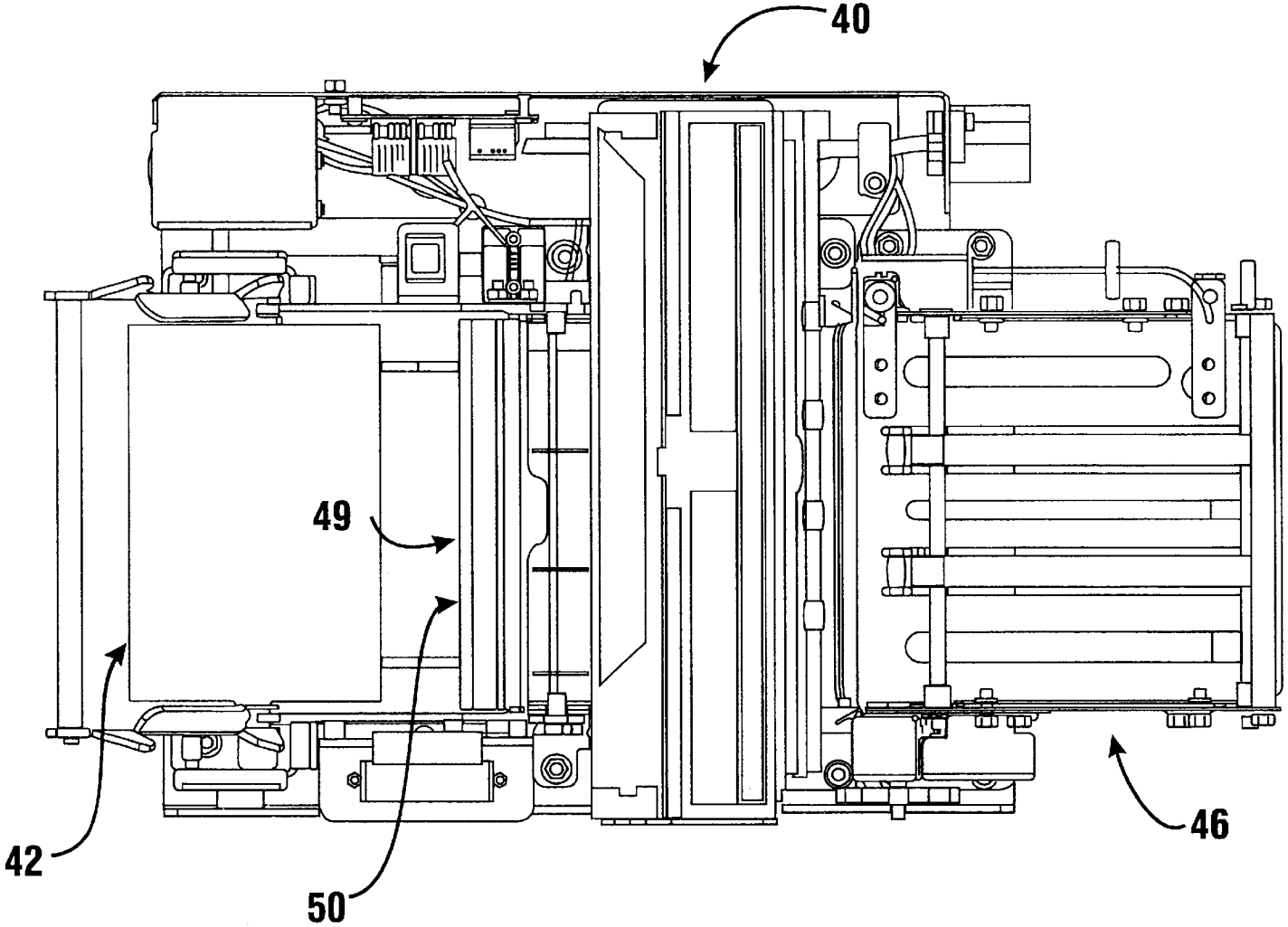
FIG. 7 is a top plan view of the thermal printing arrangement shown in FIG. 2.

FIGS. 4 and 7 show a thermal printing arrangement including an exemplary paper control device generally indicated 49. The paper control device 49 of the exemplary embodiment includes a spring device 50. Spring device 50 operates to engage the paper web and to change the configuration of the path thereof so that resistance to paper movement remains generally constant which is defined for purposes of this exemplary embodiment as being within a suitable range for avoiding any significant slip by the drive in moving the paper web during printing. Paper control device 49 of the exemplary embodiment includes a movable entry guide 54. Pin members 56 and 58 of the exemplary embodiment are used to support the spring device and entry guide.

Figure 8:
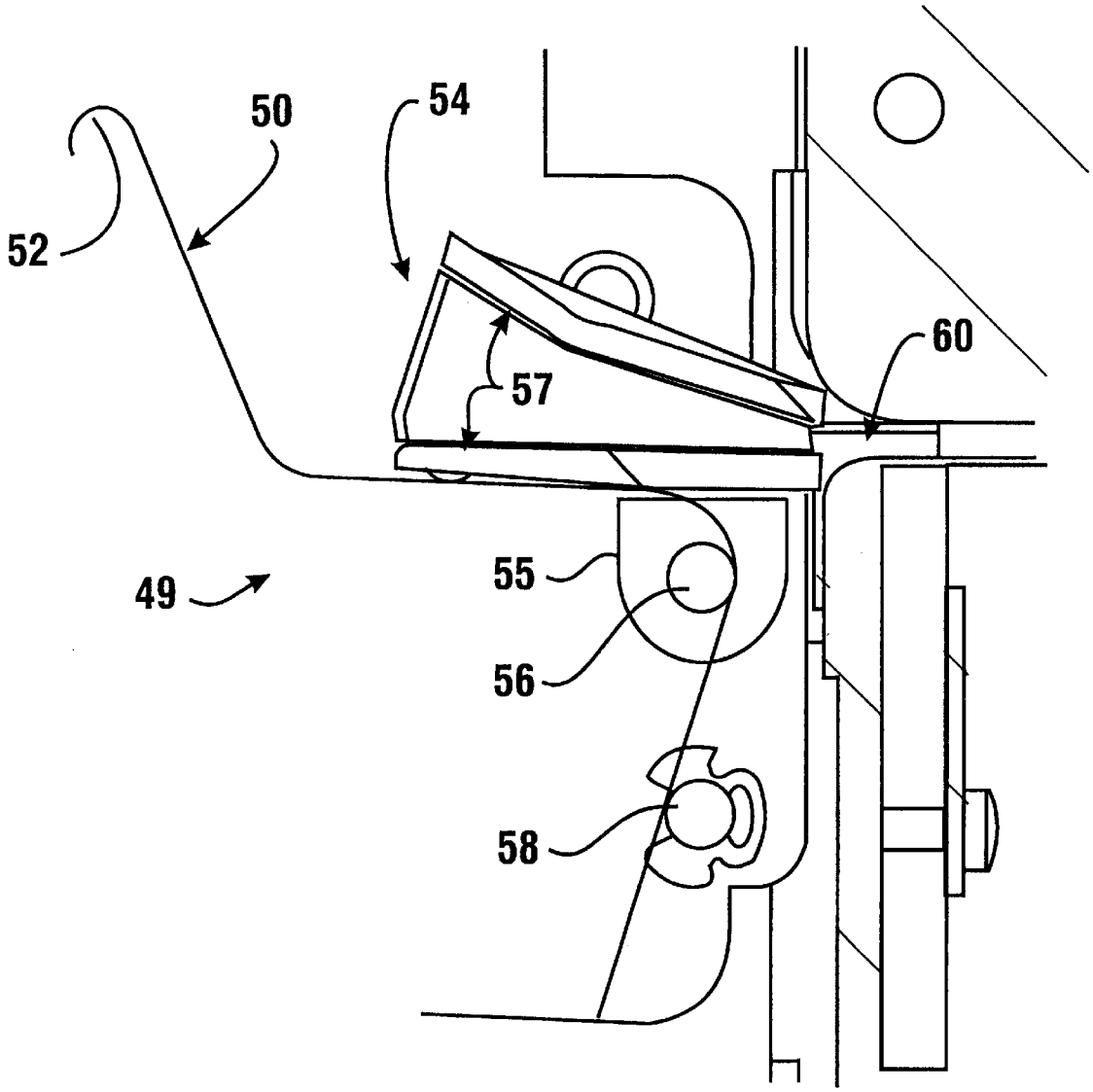
FIG. 8 shows an enlarged view of the paper control device of the exemplary embodiment.
Figure 9:
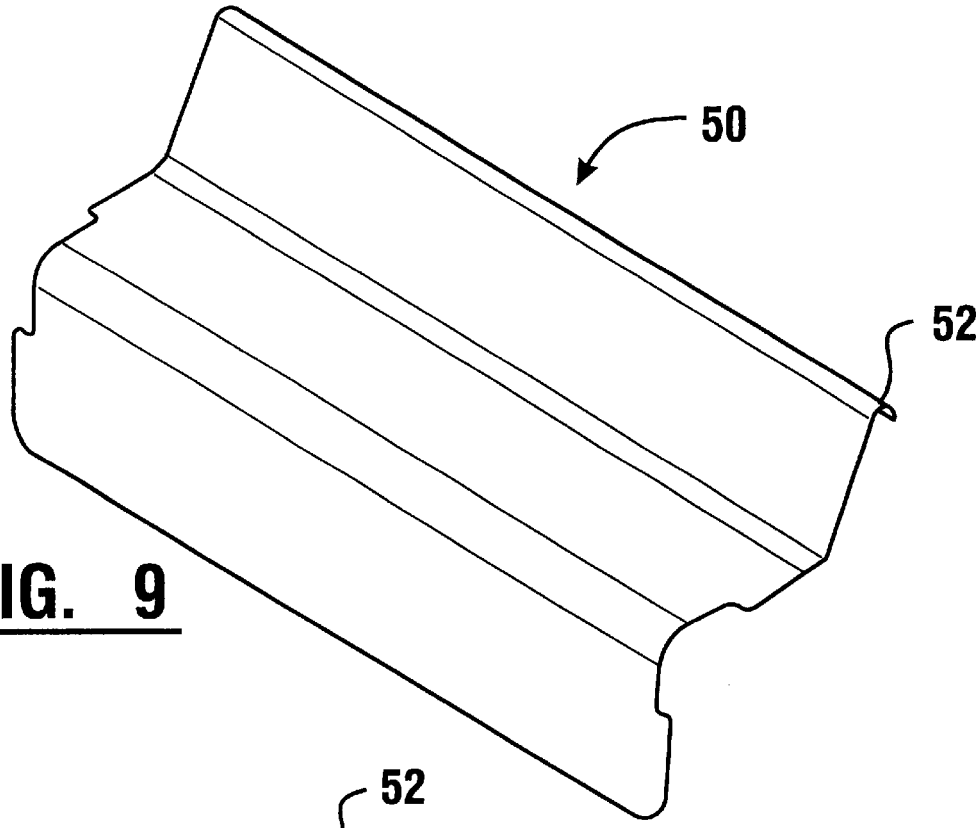
FIG. 9 shows an isometric view of the spring device used in the paper control device.
Figure 10:
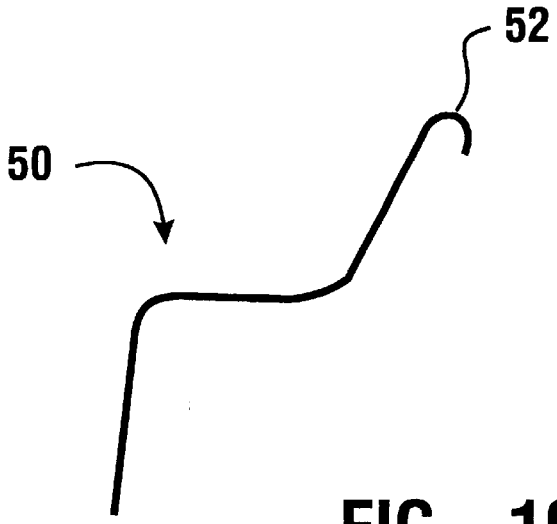
FIG. 10 shows a side view of the spring device in an undeformed condition.

The spring device 50 is shown in greater detail in FIGS. 8 through 10. The exemplary form of the spring device 50 includes a deformable member which may be comprised of metal or other suitable material having resilient or spring-like properties. The spring device 50 is deformable from the undeformed configuration which is generally a "z-shape" as shown in FIGS. 9 and 10, and in the operative condition changes shape to conform with the positions of pin members 56 and 58. The biasing force which results from such deformation operates to help hold the exemplary spring device 50 in position. The spring device also includes a relatively wide, generally smoothly curved contoured engaging portion 52. Engaging portion 52 which may comprise an integral or separate component, is positioned adjacent the end of the spring device and operates to engage the paper web in a manner later described. The engaging portion preferably operates to engage the paper web and apply force thereto without tearing or damaging the paper. Engaging portion 52 is also movable in the manner later discussed so as to change the configuration of the paper web and to modify the force which must be overcome by the paper drive to achieve paper movement in the printing direction.

Figure 12:
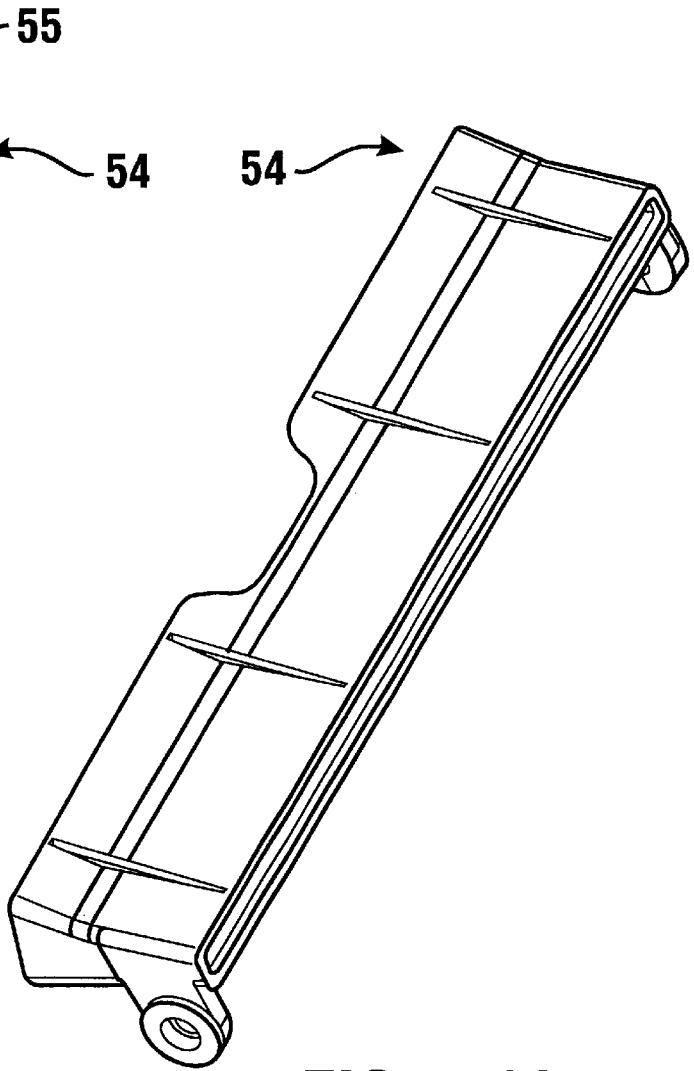
FIG. 12 is a top isometric view of the printer entry guide shown in FIG. 11.
Figure 11:
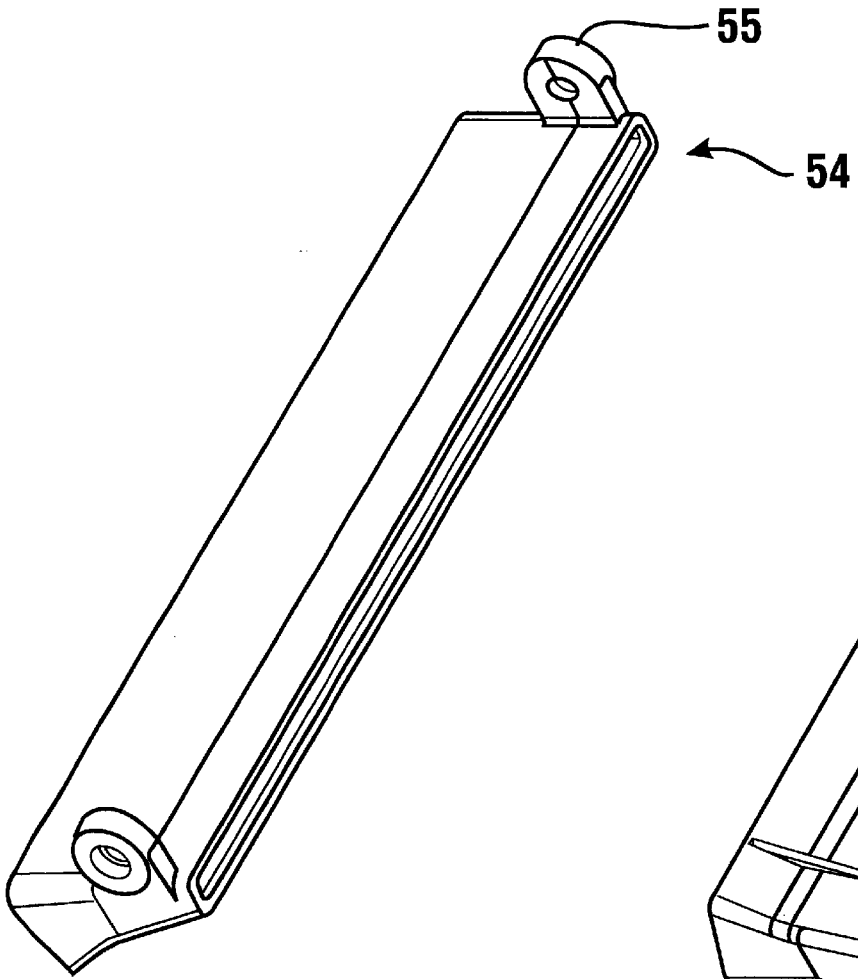
FIG. 11 is a bottom isometric view of a printer entry guide used in the exemplary paper control device.

The exemplary form of the entry guide 54 is shown in greater detail in FIGS. 8, 11 and 12. The entry guide 54 of the exemplary embodiment includes a paper passage that is generally funnel shaped in cross section. This shape includes interior guide surfaces 57 at least one of which has a tapered portion and which surfaces are configured to support and guide the paper web through the paper guide to an entry location 60 of the printer 40 without tearing or cutting the paper. Guide 54 includes two ear portions 55 adjacent the transverse ends thereof. As shown in FIG. 8 each ear portion 55 is in supporting connection with a pin member 56. This mounting enables the guide 54 to pivotally move relative to the housing of the printing apparatus.

As can be appreciated from FIG. 8, in this exemplary embodiment the spring device 50 provides a force which acts on the entry guide 54 and positions the entry guide relative to the engaging portion 52. As a result, the position of the entry guide 54 is automatically adjusted responsive to the contour of the paper web as it is modified due to the position of the spring device. Of course, it should be understood that the construction and operation of the paper control device 49 is exemplary and in other embodiments of the invention other devices and mechanisms may be used to carry out the principles of the invention.

Figure 5:
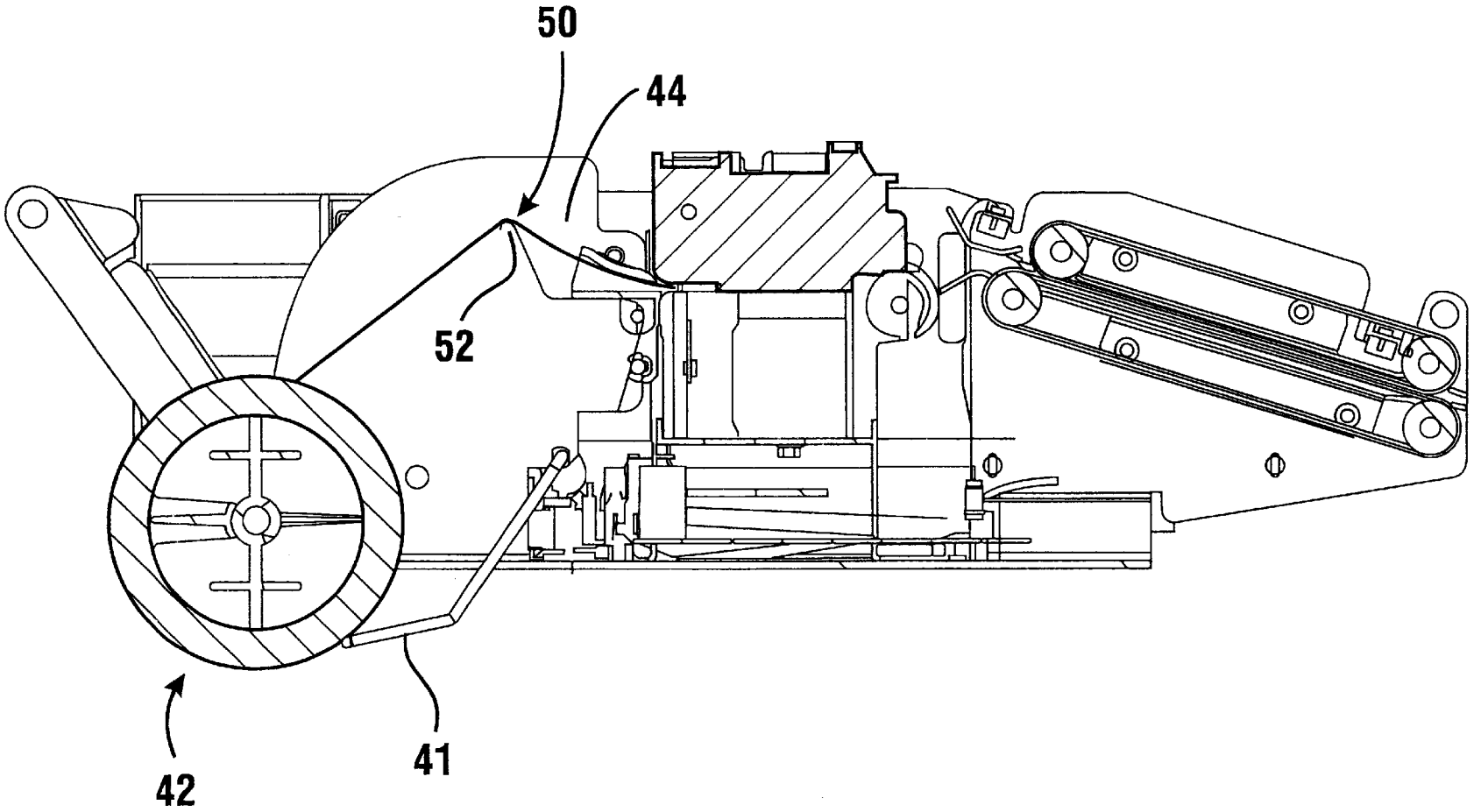
FIG. 5 shows the paper control device of FIG. 4 in a first operative position after a paper web has been retracted.
Figure 6:
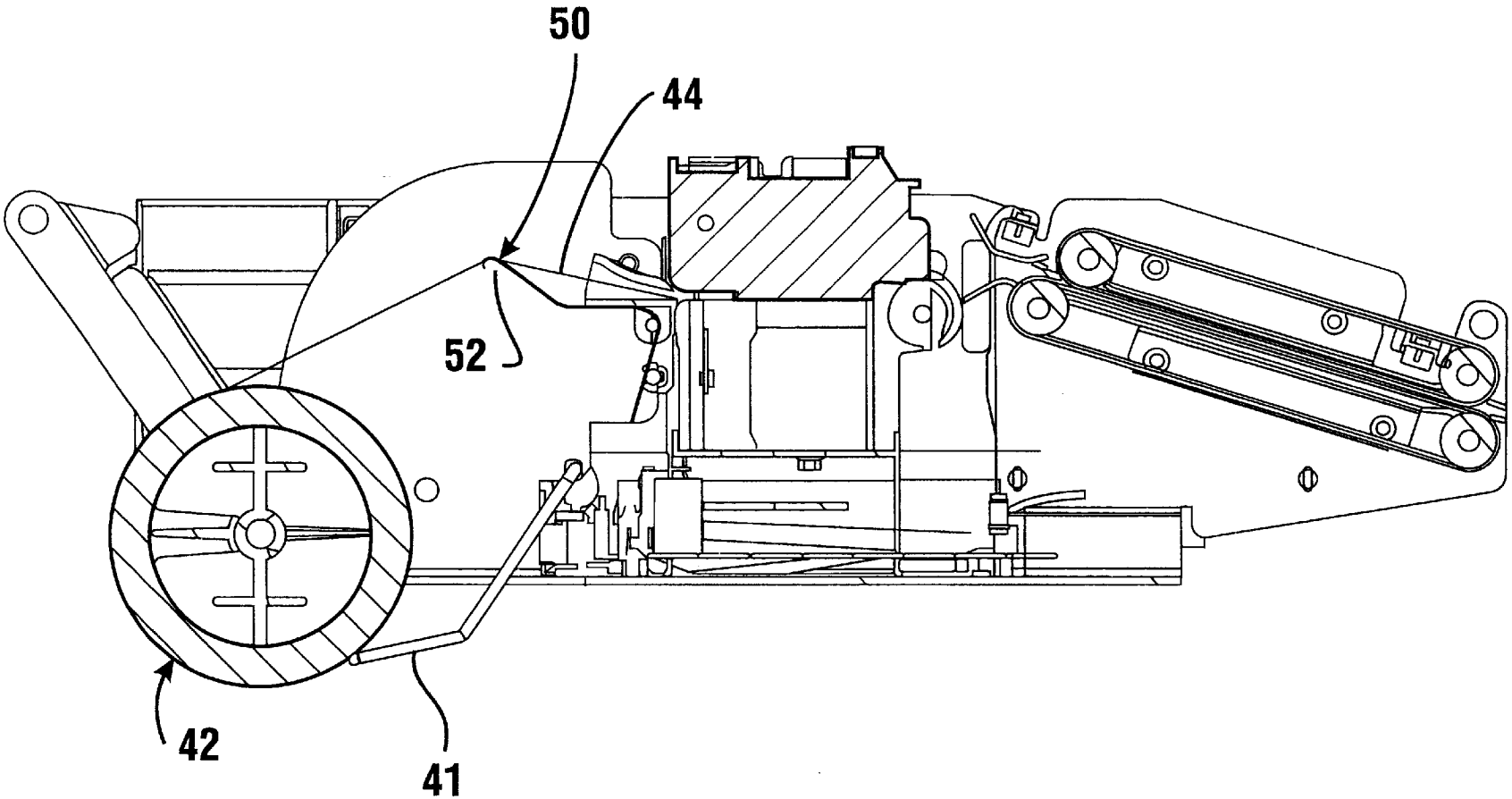
FIG. 6 shows the paper control device of FIG. 4 in an alternative position after the paper has moved in the printing direction a distance beyond that associated with the paper control device position shown in FIG. 5.

FIGS. 5 and 6 demonstrate the operation of the exemplary embodiment of the paper control device 49. The paper control device operates to act on the web 44 between the paper roll and the printer drive. The paper control device operates to change the orientation of the paper web as well as to facilitate guiding of the paper web into the entry location of the printer throughout the range of web orientations. Specifically, the orientation of the spring device 50 of the exemplary paper control device causes the paper web to move relative to the printer drive so that after the paper has been retracted untensioned slack in the web is minimized. When the printer drive begins moving the paper forward in the printing direction the resistance force to such paper movement is maintained generally constant and within a suitable range to avoid slipping of the paper relative to the movement of the drive. As a result, no excessive resistance forces are encountered and printing is enabled to be carried out without significant slippage which minimizes the risk of damage to the paper and/or distortion of printed indicia.

FIG. 5 shows the exemplary thermal printing arrangement of FIG. 4 in operation to maintain suitable resistance force in the paper web and to prevent excessive rapid fluctuation in resistance force. In the position shown, the paper web and paper control device are in a position in which slack in the web has been taken up, such as when the paper has been retracted to carry out a cutting operation. During retraction, the paper moves in the direction opposite to the normal direction of paper movement during printing. The spring device 50 moves the web so that the drag force applied by drag device 41 is maintained on the paper in the web between the roll and the printer. The angular position of the end portion 52 of the spring device 50 also changes the vertical and horizontal components of the resistance force applied by the web when the web is again moved by the drive in the printing direction. This change in web contour increases the amount of force that the drive needs to apply initially as the paper web begins moving forward in the printing direction.

FIG. 6 shows the configuration of the paper control device when the drive has been moving the paper web forward in the printing direction a substantial distance from the paper position shown in FIG. 5. In this condition, the spring device is moved from the position shown in FIG. 5 due to the forces acting thereon. These forces include the resistance to forward movement of the web provided by the drag device 41 and the inertial forces associated with moving paper roll 42. In this translated position, the configuration of the web is changed and the position of engaging portion 52 of the spring device causes the driving force on the web to be applied more directly in a generally horizontal direction as shown. This provides for the driving force to act more directly on the paper roll. As a result, the resistance to paper movement experienced by the printer drive is maintained constant and within the desired range.

The exemplary form of the invention avoids the condition which might otherwise occur in the absence of the paper control device, which may cause the drive to have little resistance to paper movement and then suddenly encounter a very high resistance to paper movement. This may cause the paper to slip relative to movement of the drive and distortion to occur in the printed indicia. As can also be appreciated, the movement of the spring device 50 also causes the entry guide 54 to move rotatably about pin members 56. The movement of the entry guide is responsive to the orientation of the spring device and serves to guide the paper web smoothly on the guide surfaces 57 to the entry location 60 of the printer regardless of the orientation of the web.

It should further be appreciated that while the normal operation of the exemplary embodiment does not generally result in untensioned slack in the web when the paper is retracted, the exemplary embodiment operates to minimize the risk of sudden force fluctuations and application of force above a threshold, above which the paper will substantially slip relative to movement of the drive even when untensioned slack is present in the web. This is achieved because if untensioned slack is present in the web, movement in the printing direction eventually causes the web to act against the spring device 50. The spring device 50 will initially be in the undeformed position as shown in FIG. 4. As the web continues to be moved by the drive the spring device will begin to deform from its initial undeformed condition. This results in a relatively gradual application of resistance force on the web rather than an abrupt application of resistance force as might occur if the paper control device were not present. Of course the force on the web eventually rises to the point where the roll begins moving to unwind the paper web therefrom. As a result the exemplary form of the invention can maintain the resistance force generally constant which for purposes of this embodiment is within a range which extends from negligible resistance to a threshold resistance level which remains below that which would cause the paper to substantially slip relative to movement of the drive.

The exemplary paper control device of the present invention maintains the resistance force to paper movement in the printing direction generally constant within a suitable range. The resistance force is maintained during times after the paper has been moved in a direction opposed to that in which the paper normally moves during printing. This is achieved in the exemplary embodiment by providing a change in the orientation of the portion of the paper web being acted on by the drive which moves the paper web, so that the components of the resistance force are adjusted as the web orientation changes. It should be understood however, that this function may be accomplished in other ways through the use of other types of members and mechanisms that can operate to take up the slack in a paper web as the paper is retracted, maintain in a portion of the paper that has been retracted a suitable resistance force to forward paper movement, and/or which minimizes abrupt, irregular or unduly high resistance forces which may cause paper slippage and resulting distortion in the printed indicia. The principles of the present invention may be employed using numerous methods and devices other than those described in connection with the exemplary embodiment.

While the exemplary form of the present invention has been described with regard to the printing of account statements, the principles of the invention may be applied to other types of printed articles. These principles may be applied, for example, in the printing of reports, graphs, spreadsheets, maps, tickets or other documents that are required to be printed on relatively large paper. Likewise the principles of the invention may be applied in circumstances where it is necessary to move the paper in opposed directions during printing other than for cutting, or in other circumstances where relatively large or irregular forces may be encountered.

Thus, the automated transaction machine of the present invention achieves at least one of the above stated objectives, eliminates difficulties encountered in the use of prior devices and systems, solves problems and attains the desirable results described herein.

In the foregoing description, certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the details shown and described.

In the following claims, any feature described as a means for performing a function shall be construed as encompassing any means known to those skilled in the art to be capable of performing the recited function, and shall not be deemed limited to the features and structures shown herein or mere equivalents thereof.

Having described the features, discoveries and principles of the invention, the manner in which it is constructed and operated and the advantages and useful results attained; the new and useful structures, devices, elements, arrangements, parts, combinations, systems, equipment, operations, methods and relationships are set forth in the appended claims.

We claim:

1. An apparatus comprising:

a printing device, a paper drive, and a paper supply, wherein the paper drive is operative to move paper between the paper supply and the printing device, wherein in moving the paper in a first direction the paper drive meets resistance to paper movement, a paper control device including a deformable member, wherein the deformable member is deformable responsive to paper movement in the first direction, a paper engaging portion associated with the deformable member, wherein the paper engaging portion is operative to engage the paper between the paper drive and the paper supply, a paper entry guide, wherein the paper entry guide is positioned between the paper engaging portion and the paper drive, wherein the paper entry guide is movably mounted and the deformable member is operatively connected to the paper entry guide, wherein the paper control device is operative to apply a generally constant resistance to paper movement in the first direction by the paper drive.

2. The apparatus according to claim 1 wherein the apparatus comprises an automated transaction machine, wherein the printing device, paper drive, paper supply, and paper control device are located in the automated transaction machine, and wherein the automated transaction machine is structurally capable of carrying out transactions involving transfers of value.

3. The apparatus according to claim 2 wherein the machine includes a housing, wherein the printing device is located inside the housing and is operative to print an account statement.

4. The apparatus according to claim 2 wherein the machine includes a currency dispenser.

5. The apparatus according to claim 2 wherein the machine includes a depository.

6. The apparatus according to claim 2 wherein the machine includes an ATM card reader.

7. The apparatus according to claim 1 wherein the deformable member comprises a spring device.

8. The apparatus according to claim 7 wherein the spring device has a first end and a second end, and wherein the paper engaging portion is positioned at an end of the spring device.

9. The apparatus according to claim 8 wherein the paper engaging portion is formed from the spring device.

10. The apparatus according to claim 8 wherein the paper engaging portion has a curved contour.

11. The apparatus according to claim 8 wherein the spring device is Z-shaped.

12. The apparatus according to claim 1 wherein the paper entry guide comprises at least one interior surface configured to guide paper.

13. The apparatus according to claim 12 wherein the at least one interior surface of the paper entry guide comprises a tapered portion.

14. The apparatus according to claim 1 wherein the spring device is adapted to provide a force to act on the entry guide to move the entry guide relative to the engaging portion.

15. The apparatus according to claim 1 wherein the printing device is in supporting connection with a housing, wherein the paper entry guide is pivotally mounted relative to the housing.

16. The apparatus according to claim 1 wherein the paper control device is arranged relative to the paper drive to maintain resistance to paper movement by the paper drive in the first direction below a threshold above which the paper tends to slip relative to the drive.

17. The apparatus according to claim 16 wherein the paper control device is arranged relative to the paper drive to maintain resistance to paper movement in the first direction within a range below the threshold.

18. The apparatus according to claim 1 wherein the paper supply comprises a paper roll and further comprising a drag device operatively engaging the paper roll to resist movement of the paper in the first direction.

19. The apparatus according to claim 1 wherein the paper drive is operative to move the paper in a second direction opposed of the first direction.

20. The apparatus according to claim 19 wherein the paper control device is operative to take up untensioned slack in the paper moving in the second direction.

21. The apparatus according to claim 1 wherein the printing device comprises a cutter, wherein the paper drive moves the paper in a second direction responsive to operation of the cutter cutting the paper.

22. The apparatus according to claim 1 wherein the paper control device is operative to vary the angular configuration of the paper relative to the paper drive.

23. The apparatus according to claim 1 wherein the printing device comprises a thermal printer.

24. The apparatus according to claim 1 wherein the paper supply includes paper at least five inches wide.

25. An automated transaction machine comprising:

a printing device, a paper drive, and a paper supply, wherein the paper drive is operative to move paper between the paper supply and the printing device, wherein in moving the paper in a first direction the paper drive meets resistance to paper movement, a paper control device operative to engage the paper between the paper drive and the paper supply, wherein the paper control device is operative to apply a generally constant resistance to paper movement in the first direction by the paper drive, wherein the paper control device comprises a deformable member, and wherein the paper control device further comprises a movable paper entry guide positioned to engage the paper intermediate of where the paper engages the deformable member and where the paper engages the paper drive.

26. The apparatus according to claim 25 wherein the deformable member comprises a spring device.

27. An apparatus comprising:

a printer apparatus including:

a printer device, a paper drive, a paper supply, wherein the paper drive is operative to move paper between the paper supply and the printer device, wherein the paper drive meets resistance to paper movement in a first direction, a paper control device, wherein the paper control device is operative to affect a generally constant resistance to paper movement in the first direction by the paper drive, wherein the paper control device comprises a spring device having a first end and a second end, wherein the spring device has a paper engaging portion at an end thereof, wherein the paper engaging portion has a curved portion, wherein the curved portion is operative to engage the paper between the paper drive and the paper supply, wherein the paper control device further comprises a paper entry guide, wherein the paper entry guide is positioned between the paper engaging portion and the paper drive, wherein the paper entry guide comprises in cross section an interior funnel shaped paper passage configured to guide paper, wherein the spring device is operatively connected to the paper entry guide.

28. The apparatus according to claim 27 wherein the apparatus comprises an automated transaction machine, wherein the printer device, paper drive, paper supply, and paper control device are located in the automated transaction machine, and wherein the automated transaction machine is structurally capable of carrying out transactions involving transfers of value.

29. The apparatus according to claim 27 wherein the paper control device is arranged relative to the paper drive to maintain resistance to paper movement by the paper drive in the first direction below a threshold above which the paper tends to slip relative to the drive.

30. A method comprising:

(a) operating a paper drive of a printer apparatus to move paper in a first direction between a paper supply and the paper drive in an automated transaction machine, (b) biasing the paper with a deformable member between the paper supply and the paper drive, affecting resistance to paper movement in the first direction by deforming the deformable member a greater amount with increased resistance, and maintaining resistance to paper movement in the first direction to below a level at which the paper substantially slips relative to the drive.

31. The method of claim 30 wherein step (b) comprises:

maintaining a generally constant resistance to paper movement by the paper drive in the first direction.

32. The method of claim 30 and further comprising printing an account statement with the printer apparatus.

33. The method according to claim 30 and further comprising operating the machine to carry out an ATM banking transaction.

34. A method comprising:

(a) operating a paper drive of a printer apparatus to move paper in a first direction between a paper supply and the paper drive in an automated transaction machine, (b) engaging the paper between the paper supply and the paper drive with a paper control device maintaining resistance to paper movement by the drive in the first direction to below a level at which the paper substantially slips relative to the drive, (c) moving the paper with the paper drive in a second direction opposed of the first direction.

35. The method according to claim 34 and further comprising:

(d) cutting the paper with a cutter.

36. The method according to claim 35 further comprising:

(e) delivering the cut paper to a user of the machine.

37. The method according to claim 34 and further comprising printing an account statement with the printer apparatus.

38. The method according to claim 34 and after step (c) further comprising again moving the paper in the first direction with the paper drive, wherein as the paper again moves in the first direction the paper control device gradually applies resistance to paper movement in the first direction by the paper drive.

* * * * *